US007484983B2

(12) United States Patent
Ju

(10) Patent No.: US 7,484,983 B2
(45) Date of Patent: Feb. 3, 2009

(54) CARD EDGE CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/785,605

(22) Filed: Apr. 19, 2007

(65) Prior Publication Data

US 2008/0261454 A1 Oct. 23, 2008

(51) Int. Cl.
*H01R 4/10* (2006.01)

(52) U.S. Cl. ..... 439/327; 439/83

(58) Field of Classification Search ..... 439/327, 439/83, 325, 326, 876
See application file for complete search history.

(56) References Cited

U.S. PATENT DOCUMENTS 6,039,616 A * 3/2000 Pereira et al. ..... 439/874
6,276,951 B1 * 8/2001 Chen et al. ..... 439/327
6,517,378 B2 2/2003 Fumikura
6,634,899 B2 10/2003 Takahiro et al.
6,923,668 B2 * 8/2005 Tsai ..... 439/326
7,074,067 B2 * 7/2006 Yang et al. ..... 439/326
7,198,501 B1 * 4/2007 Tsai ..... 439/326
2005/0136724 A1 * 6/2005 Lin ..... 439/326
2005/0176284 A1 * 8/2005 Chu ..... 439/327
2005/0255734 A1 * 11/2005 Liu ..... 439/326
2007/0077803 A1 * 4/2007 Tsai ..... 439/326
2007/0232111 A1 * 10/2007 Shao ..... 439/327
2008/0032537 A1 * 2/2008 Leidy ..... 439/326

* cited by examiner

*Primary Examiner*—Gary F. Paumen
(74) *Attorney, Agent, or Firm*—Rosenberg, Klein & Lee

(57) ABSTRACT

A card edge connector comprises an insulator body and a pair of metal components. A central slot is provided along the longitudinal direction of the insulator body. The pair of metal components is disposed at distal ends of two opposite sides of the insulator body. Each metal component includes a main body member fixed on the insulator body and a fixing member soldered to a printed circuit board. At least one soldering point is protrudingly provided on the fixing member. The proposed card edge connector can effectively save space, and has a simple structure. Moreover, it can be conveniently manufactured to enhance production efficiency, can be easily installed or dismantled, and can be firmly connected to a printed circuit board.

18 Claims, 5 Drawing Sheets

CARD EDGE CONNECTOR

BACKGROUND OF THE INVENTION

1. Field of the Invention

The present invention relates to a card edge connector and, more particularly, to a card edge connector capable of firmly connecting with a printed circuit board.

2. Description of Related Art

A prior art card edge connector is commonly used in the industry to connect a memory module to a printed circuit board and comprises a longitudinal insulator body and a pair of metal components. The insulator body has a central slot to bear the memory module. Some conducting terminals are disposed on both sides of the central slot, and are mechanically and electrically connected with the memory module. The pair of metal components is disposed at distal ends of two opposite sides of the insulator body. Each metal component includes a main body member fixed on the insulator body and a fixing member for soldering to a printed circuit board. The prior art card edge connector is fixed onto the printed circuit board through the fixing member. However, the fixation easily loosens, resulting in an insecure connection for the card edge connector.

The prior art discloses a card edge connector, which comprises an insulating rack installed on a motherboard and a latch member connected to the insulating rack and used to retain a daughter board at a second angle. The daughter board is first inserted into the insulating rack with a first angle and then turned to the second angle. The latch member includes a metal latch body and a metal fixing member. The metal latch body has a rack connecting member for connecting the insulating rack and a daughter board clipping member for clipping the daughter board. The metal fixing member is separated from the latch body of the motherboard. The metal fixing member is installed on a wing member formed by bending the latch body, and moves within a predetermined range in the vertical direction.

Because the latch member of the above card edge connector has a complicated structure, occupies more space, and is inconvenient to assemble and disassemble, the working efficiency cannot be effectively enhanced.

Accordingly, the present invention aims to propose a novel card edge connector to solve the above problems in the prior art.

SUMMARY OF THE INVENTION

An object of the present invention is to provide a novel card edge connector, which can be firmly connected onto a printed circuit board.

Another object of the present invention is to provide a novel card edge connector, which has a simple structure and is convenient to assemble and disassemble so that the working efficiency can be effectively enhanced.

To achieve the above objects, the present invention provides a card edge connector, which comprises an insulator body and a pair of metal components. The insulator body has a central slot provided along a longitudinal direction thereof. The pair of metal components is disposed at distal ends of two opposite sides of the insulator body. Each metal component includes a main body member fixed on the insulator body and a fixing member soldered to a printed circuit board. At least one soldering point is protrudingly disposed on the fixing member.

To achieve the above objects, the present invention provides a card edge connector, which comprises an insulator body and a pair of fixing structure. The insulator body has a central slot provided along a longitudinal direction thereof. The pair of fixing structures is disposed at distal ends of two opposite sides of the insulator body. Each fixing structure includes a metal component and a fixing component matched with the metal component. A groove for limiting the longitudinal motion of the metal component is disposed at the distal ends of both opposite sides of the insulator body. The fixing structure includes a limiting structure that limits the transverse motion of the metal component and a positioning structure that ensures the vertical motion of the metal component within a predetermined range.

As compared to the prior art, the card edge connector of the present invention can be firmly connected onto a printed circuit board, has a simple structure, and is convenient to assemble and disassemble so that the working efficiency can be effectively enhanced.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

Figure 1:
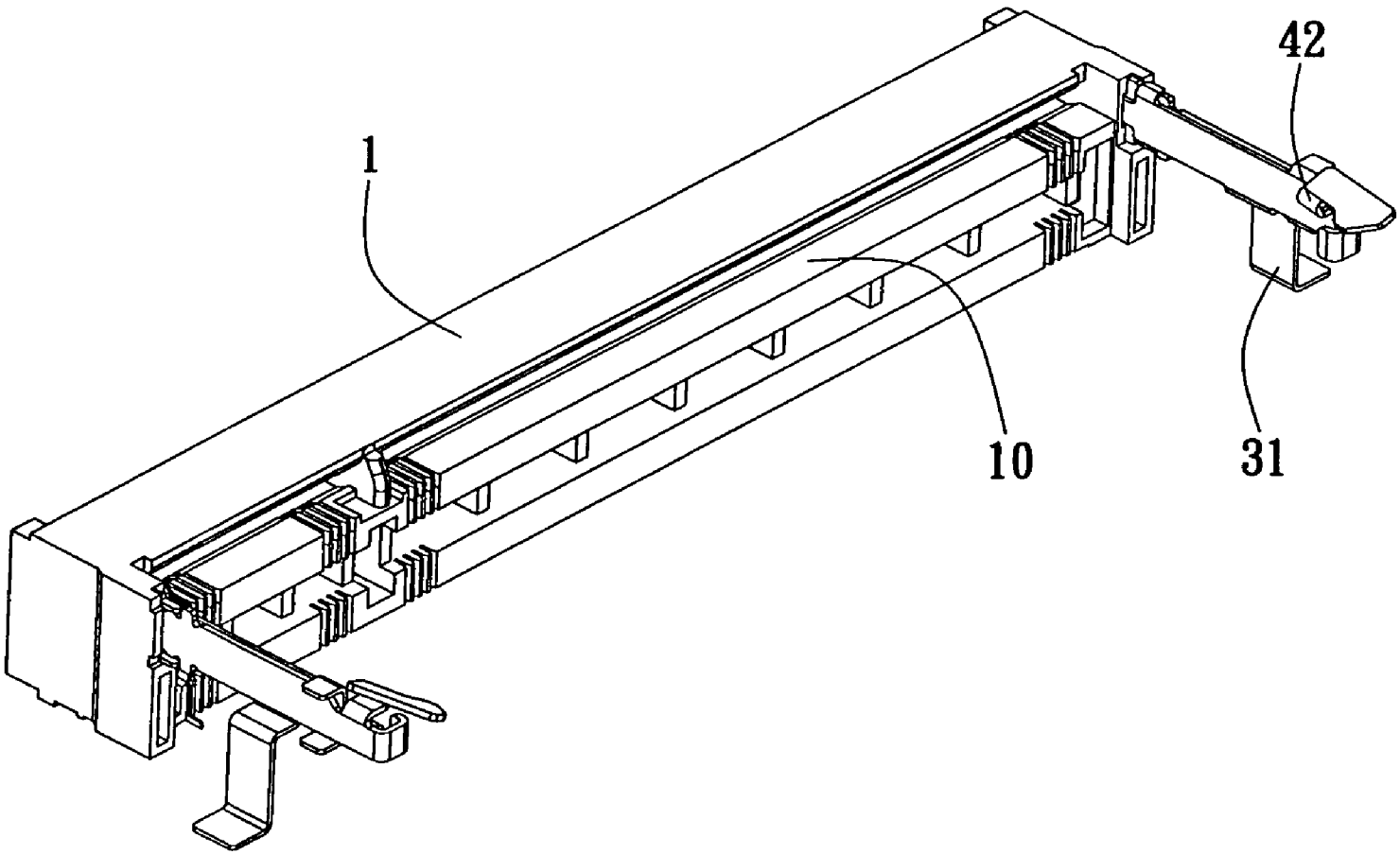
FIG. 1 is a perspective view of the card edge connector of the present invention.
Figure 2:
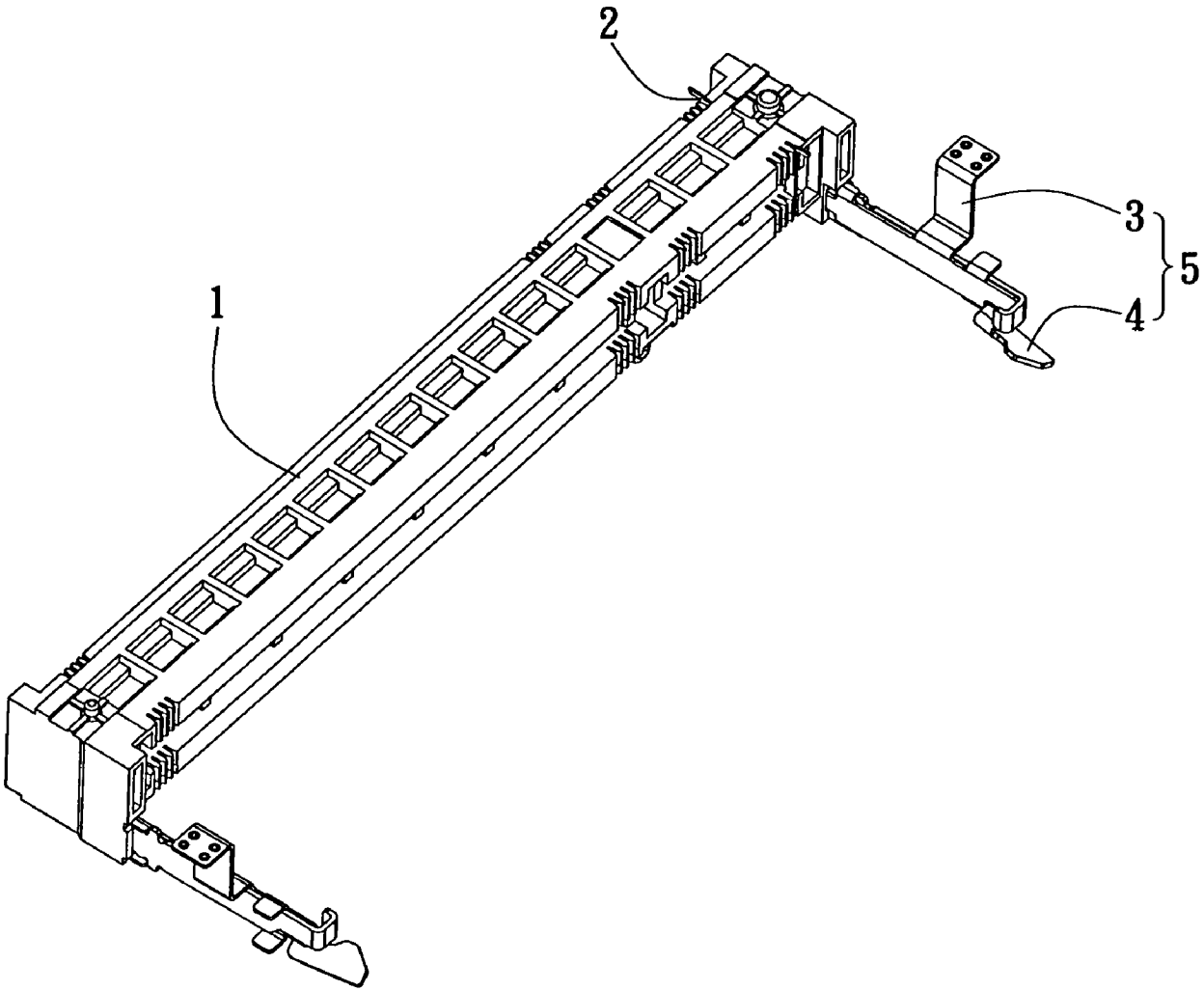
FIG. 2 is another perspective view of the card edge connector of the present invention.
Figure 3:
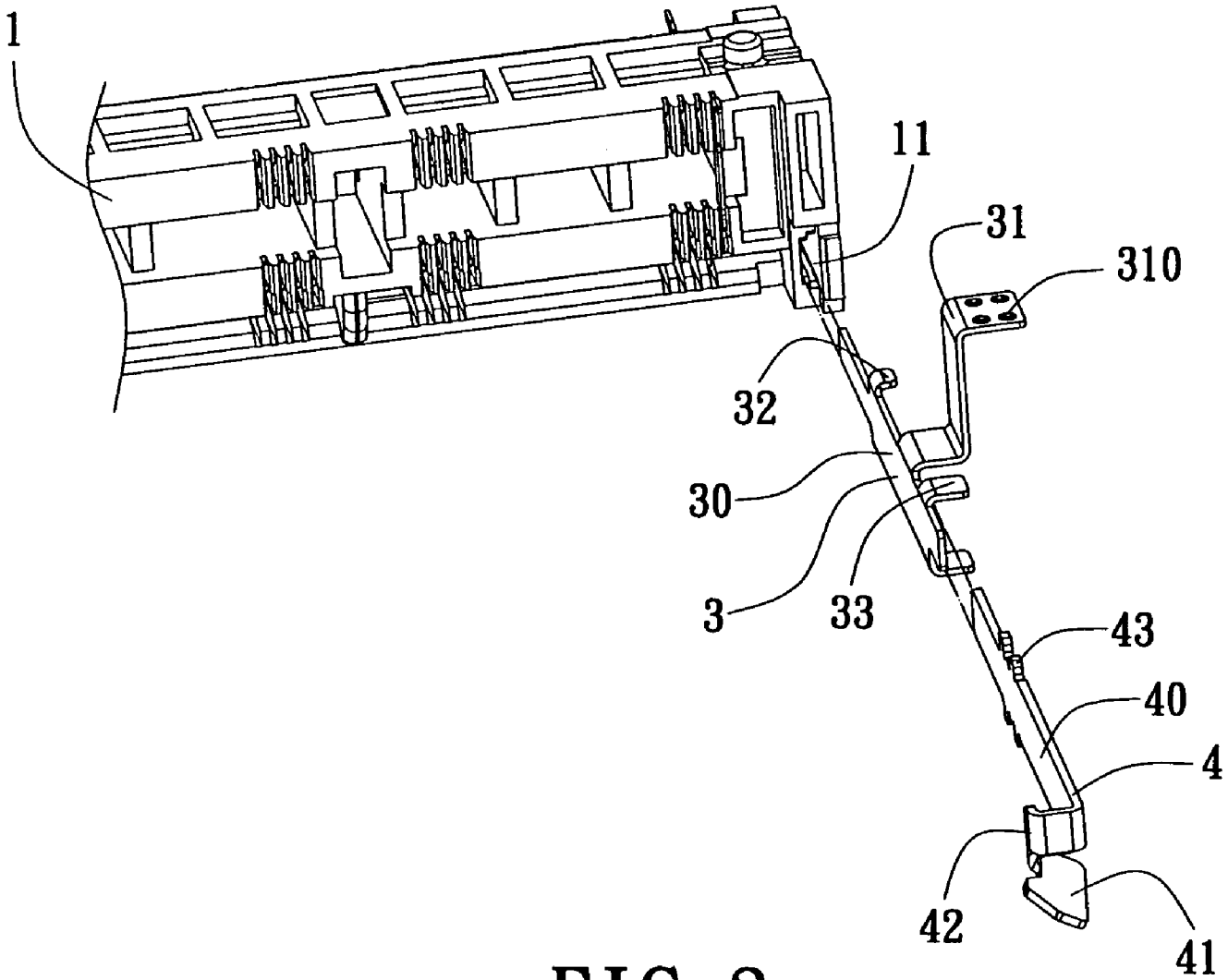
FIG. 3 is a partly perspective exploded view of the card edge connector of the present invention.

As shown in FIGS. 1 to 3, a card edge connector of the present invention can be used to bear a mating electronic component (not shown). The card edge connector comprises an insulator body 1 and a pair of metal components 3. The insulator body has a longitudinal shape, and has a central slot 10 provided along its longitudinal direction. Conducting terminals 2 are disposed on both sides of the central slot 10, and are mechanically and electrically connected with a memory module (not shown). A stepped groove 11 is disposed at the distal end of both of the opposite sides of the insulator body 1. The pair of metal components 3 is disposed in the grooves 11 at the distal ends of the two opposite sides of the insulator body 1. Each of the metal components 3 includes a main body member 30 fixed on the insulator body 1 and a fixing member 31 capable of being soldered to a printed circuit board. At least a soldering point 310 is protrudingly disposed on the fixing member 31. In this embodiment, there are four soldering points 310 disposed on the fixing member 31.

The present invention can further comprise a fixing component 4 capable of fixing a mating electronic component (not shown). The fixing component 4 and the metal component 3 are matched together to form a fixing structure 5. The fixing structure 5 is used to attach a mating electronic component. The fixing structure 5 includes a limiting structure for limiting the transverse motion of the metal component 3 and a positioning structure for ensuring the vertical motion of the metal component 3 within a predetermined range.

The main body member 30 of the metal component 3 is matched with the groove 11 of the insulator body 1. The fixing member 31 bends and extends outwards from the main body member 30 toward the fixing component 4, and then bends and extends upwards, and finally bends and extends toward the fixing component 4. At least one soldering point 310 is protrudingly disposed on the fixing member 31 (in this embodiment, there are four soldering points on the fixing member). The soldering point 310 is a protuberance on the fixing member 31, is formed by stamping, and has soldering and fastening function.

Moreover, the fixing component 4 corresponding to the metal component 3 includes a main body 40, a pulling member 41 bending and extending from a side of the main body 40, and a snapping member bent into a U-shape from the distal end of the main body 40 to fasten a mating electronic component. The pulling member 41 is on an angle with the horizontal plane, and can facilitate the pulling of the fixing component 4. The pulling member 41 is chamfered so as not to injure a user's hands.

The metal component 3 further includes a protruding member 32 bending and extending from the main body member 30. The fixing component 4 has a raised member 43 matched with the protruding member 32. The protruding member 32 and the raised member 43 together form the limiting structure. The positioning structure is a positioning member 33 that is disposed at upper and lower sides of the main body member 30 of the metal component 3 and bends and extends outwards toward the fixing component 4. The spacing between the upper and lower parts of the positioning member 33 is larger than the width of corresponding positions of the metal component 3.

The positioning member 33 allows the fixing component 4 to move in the horizontal direction without any deviation. Moreover, when the fixing component 4 is subjected to an external force in a vertical direction, the fixing component 4 won't sway up and down due to the limiting function of the positioning member 33. After the metal component 3 and the fixing component 4 are matched together, they can be inserted into the groove 11. The fixing component 4 is fixed in the groove 11 of the insulator body 1, while the metal component 3 moves freely within a certain range so that the fixing component 31 can press close to a printed circuit board to facilitate surface mounting.

The fixing component 4 is located at the outer side of the groove 11, while the metal component 3 is located on the inner sides of the groove 11. When the fixing structure is impacted by an external force, most of the external force will be concentrated on the fixing component 4 so that the metal component 3 is hardly affected by the external force, thereby preventing the fixing member 31 of the metal component 3 from loosening or coming off.

Figure 4:
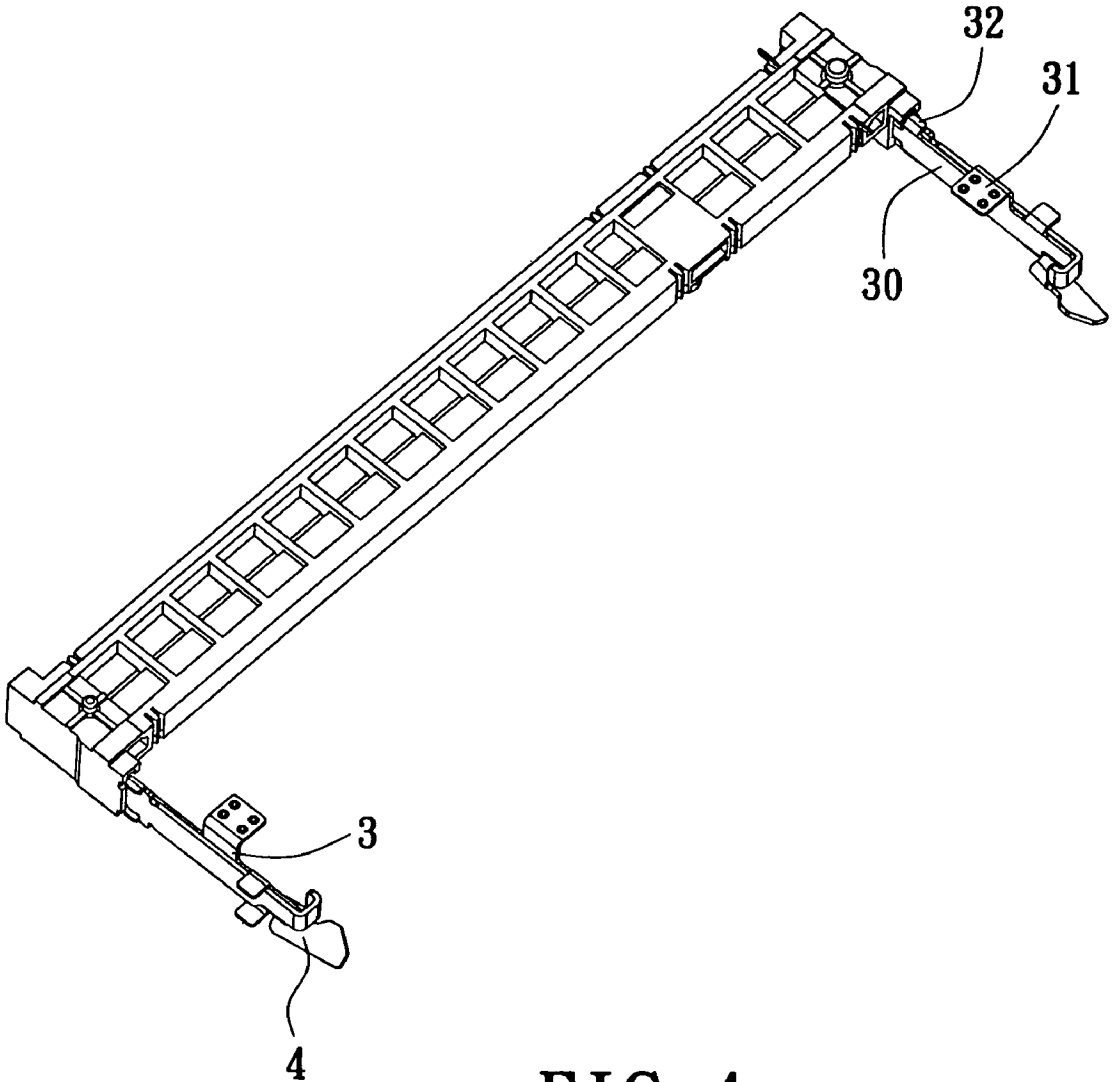
FIG. 4 is a perspective view of the card edge connector according to a second embodiment of the present invention.
Figure 5:
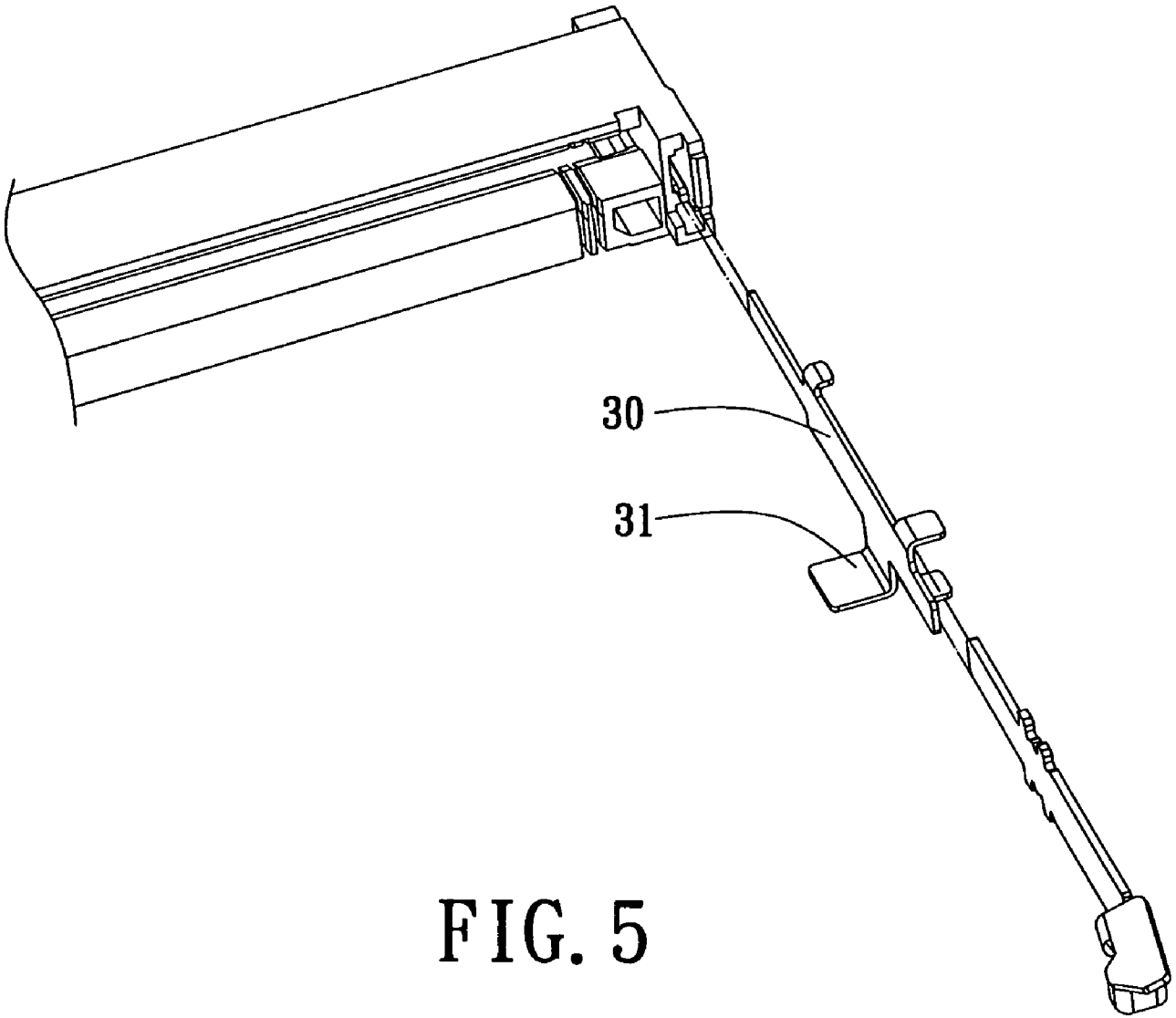
FIG. 5 is a partly perspective exploded view of the card edge connector according to the second embodiment of the present invention.

FIG. 4 is a perspective view of the card edge connector according to a second embodiment of the present invention. The second embodiment differs from the first embodiment in that the fixing member 31 is formed by bending and extending from the main body member 30 toward the direction opposite to the fixing component 4. Similarly, the same effect as above can be accomplished.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A card edge connector comprising:

an insulator body with a central slot provided along a longitudinal direction thereof;

a pair of metal components disposed at distal ends of two opposite sides of the insulator body, each of the metal components includes a main body member fixed on the insulator body and a fixing member soldered to a printed circuit board, at least one soldering point being protrudingly disposed on the fixing member; and a pair of fixing components of fixing a mating electronic component, each fixing component including:

a main body;

a pulling member bending and extending from a side of the main body, and a snapping member bent into a U shape from a distal end of the main body to fasten the mating electronic component.

2. The card edge connector as claimed in claim 1, wherein four soldering points are disposed on the fixing member.

3. The card edge connector as claimed in claim 1, wherein grooves mating with the main body members are disposed at distal ends of two opposite sides of the insulator body, and the grooves have a step shape.

4. The card edge connector as claimed in claim 1, wherein one of the fixing components and one of the metal components form a fixing structure.

5. The card edge connector as claimed in claim 4, wherein the fixing structure includes a limiting structure that limits transverse motion of the metal component and a positioning structure that ensures vertical motion of the metal component within a predetermined range.

6. The card edge connector as claimed in claim 5, wherein the limiting structure has a protruding member disposed on the fixing component and a raised member disposed on the metal component that matches the protruding member.

7. The card edge connector as claimed in claim 5, wherein the positioning structure is a positioning member that is disposed at upper and lower sides of the main body member of the metal component and bends and extends outwards toward the fixing component, and the spacing between the upper and lower parts of the positioning member is larger than the width of corresponding positions of the metal component.

8. The card edge connector as claimed in claim 4, wherein the fixing member bends and extends outwards toward the fixing component from the main body member, and then bends and extends vertically and upwards, and finally bends and extends toward the fixing component.

9. The card edge connector as claimed in claim 1, wherein the fixing member bends and extends inwards from the main body member.

10. A card edge connector comprising:

an insulator body with a central slot provided along a longitudinal direction thereof; and a pair of fixing structures disposed at distal ends of two opposite sides of the insulator body, each of the fixing structures includes a metal component and a fixing component matched with the metal component;

whereby a groove for limiting longitudinal motion of the metal component is disposed at a distal end of each of two opposite sides of the insulator body, and the fixing structure includes a limiting structure that limits transverse motion of the metal component and a positioning structure that ensures vertical motion of the metal component within a predetermined range, the positioning structure being a positioning member that is disposed at upper and lower sides of the metal component and bends and extends outwards toward the fixing component, and the spacing between the upper and lower parts of the positioning member is larger than the width of corresponding positions of the metal component.

11. The card edge connector as claimed in claim 10, wherein a matching member loosely received in the groove is disposed at a distal end of the metal component.

12. The card edge connector as claimed in claim 11, wherein the groove has a stepped shape, and the fixing component is fixedly received in the groove.

13. The card edge connector as claimed in claim 10, wherein the limiting structure has a protruding member disposed on the fixing component and a raised member disposed on the metal component that matches the protruding member.

14. The card edge connector as claimed in claim 10, wherein the metal component has a fixing member soldered to a printed circuit board.

15. The card edge connector as claimed in claim 14, wherein the metal component also includes a main body member, and the fixing member bends and extends outwards toward the fixing component from the main body member, and then bends and extends vertically and upwards, and finally bends and extends toward the fixing component.

16. The card edge connector as claimed in claim 15, wherein the fixing member bends and extends inwards from the main body member.

17. The card edge connector as claimed in claim 14, wherein at least one soldering point is protrudingly disposed on the fixing member.

18. A card edge connector comprising:

an insulator body with a central slot provided along a longitudinal direction thereof; and a pair of fixing structures disposed at distal ends of two opposite sides of the insulator body, each of the fixing structures includes a metal component and a fixing component matched with the metal component, the fixing component including a main body, a pulling member bending and extending from a side of the main body, and a snapping member bending into a U shape from a distal end of the main body to fasten a mating electronic component;

whereby a groove for limiting longitudinal motion of the metal component is disposed at a distal end of each of two opposite sides of the insulator body, and the fixing structure includes a limiting structure that limits transverse motion of the metal component and a positioning structure that ensures vertical motion of the metal component within a predetermined range.

* * * * *